US006840601B2

(12) United States Patent
Miyata

(10) Patent No.: US 6,840,601 B2
(45) Date of Patent: Jan. 11, 2005

(54) LIQUID-JET HEAD AND LIQUID-JET APPARATUS

(75) Inventor: Yoshinao Miyata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 49 days.

(21) Appl. No.: 10/395,856

(22) Filed: Mar. 25, 2003

(65) Prior Publication Data

US 2003/0214564 A1 Nov. 20, 2003

(30) Foreign Application Priority Data

Mar. 25, 2002 (JP) ..... 2002-083876
Mar. 20, 2003 (JP) ..... 2003-078456

(51) Int. Cl.[7] ..... B41J 2/045
(52) U.S. Cl. ..... 347/70
(58) Field of Search ..... 347/68, 70, 71

(56) References Cited

U.S. PATENT DOCUMENTS 5,984,459 A * 11/1999 Takahashi et al. ..... 347/70
6,416,680 B1 * 7/2002 Mitsuzawa et al. ..... 216/27

FOREIGN PATENT DOCUMENTS

JP 05286131 A 11/1993

* cited by examiner

*Primary Examiner*—Michael S. Brooke
(74) *Attorney, Agent, or Firm*—Sughrue Mion, PLLC

(57) ABSTRACT

Disclosed are a liquid-jet recording head and a liquid-jet recording apparatus, which are capable of retaining a fine liquid ejecting characteristic and obtaining a stable liquid ejecting characteristic. The liquid-jet recording head, which is provided with a passage-forming substrate formed with pressure generating chambers 12 to communicate with nozzle orifices, and piezoelectric elements provided on one side of the passage-forming substrate through a vibration plate to generate pressure changes inside the pressure generating chambers, includes an insulation layer continuously provided at least in a region opposing to the vicinity of longitudinal end portions of the piezoelectric elements along a direction of arrangement of the piezoelectric elements, the insulation layer also having a penetrated portion in a region opposing to a common electrode provided in common to the plurality of piezoelectric elements, and a connective wiring layer continuously provided on the insulation layer to be electrically connected to the common electrode via the penetrated portion. Accordingly, a resistance value of the common electrode is substantially reduced.

13 Claims, 10 Drawing Sheets

LIQUID-JET HEAD AND LIQUID-JET APPARATUS

BACKGROUND OF THE INVENTION

1. Field of the Invention

The present invention relates to an liquid-jet recording head and an liquid-jet recording apparatus, in which part of a pressure generating chamber to communicate with a nozzle orifice for ejecting liquid droplets is composed of a vibration plate and a piezoelectric element is formed on a surface of this vibration plate so as to cause ejecting of liquid droplets by displacement of the piezoelectric element. More particularly, the present invention relates to an ink-jet recording head that ejects ink as the liquid and to an ink-jet recording apparatus.

2. Description of the Prior Art

An ink-jet recording head, in which part of a pressure generating chamber to communicate with a nozzle orifice for ejecting ink droplets is composed of a vibration plate so as to cause ejecting of ink droplets out of the nozzle orifice by displacing this vibration plate with a piezoelectric element and thereby pressurizing the ink in the pressure generating chamber, has two types that are already in practical use, namely, one using a piezoelectric actuator of a longitudinal vibration mode which expands and contracts in an axial direction of a piezoelectric element, and one using a piezoelectric actuator of a flexure vibration mode.

The former one enables fabrication of a head suitable for high-density printing because the volume of the pressure generating chamber is made variable by allowing an end surface of the piezoelectric element to abut on a vibration plate. On the other hand, the former one has a problem that the fabrication process becomes complicated since a difficult process of carving the piezoelectric elements into comb-teeth shapes so as to be aligned with an arrangement pitch of the nozzle orifices, and an operation of positioning and fixing the carved piezoelectric elements onto the pressure generating chambers are required.

On the contrary, the latter one enables formation of the piezoelectric elements on the vibration plates by a relatively simple process of attaching a green sheet made of a piezoelectric material so as to agree with the shapes of the pressure generating chambers and then by baking the green sheet. However, the latter one has a problem that a high-density arrangement becomes difficult because a certain degree of area is required to utilize flexure vibration therein.

Meanwhile, in order to solve the inconvenience of the latter recording head, there is proposed a technology in which a uniform piezoelectric layer is formed over the entire surface of the vibration plate by use of a film-forming technology and this piezoelectric layer is carved into shapes corresponding to pressure generating chambers by a lithography method to form piezoelectric elements individually for the respective pressure generating chambers (refer to, for example, Japanese Patent Laid-Open No. 5(1993)-286131).

According to this technology, an operation of attaching piezoelectric elements to a vibration plate becomes unnecessary. Therefore, the technology provides not only a capability of forming the piezoelectric elements in high density by use of the accurate yet simple technique called the lithography method, but also provides an advantage that high-speed driving can be achieved by virtue of reducing the thickness of the piezoelectric element.

However, in such an ink-jet recording head having piezoelectric elements arranged in high density, one of electrodes (a common electrode) of each piezoelectric element is provided in common to a plurality of piezoelectric elements. Accordingly, if many piezoelectric elements are driven simultaneously to eject many ink droplets at one time, there occurs a problem that a voltage drop arises and the amount of displacement of the piezoelectric elements becomes unstable, whereby an ink ejecting characteristic is deteriorated.

Such a problem may be solved by increasing the thickness of the common electrode of the piezoelectric elements. However, since this common electrode includes part of the vibration plate, the amount of displacement of the vibration plate drops due to the drive of the piezoelectric elements. Alternatively, this problem may be solved by increasing the area of the common electrode. However, the size of the head is increased in this case.

Moreover, the electrodes of the piezoelectric elements formed of thin films have relatively high resistance values because of the films are thin. Therefore, the problems as stated above are very likely to occur.

Note that such a problem as described above needless to say occurs in other liquid-jet heads ejecting liquids other than ink, similarly to the ink-jet recording head ejecting ink.

SUMMARY OF THE INVENTION

In consideration of the foregoing circumstances, it is an object of the present invention to provide a liquid-jet recording head and a liquid-jet recording apparatus, which are capable of retaining a fine liquid ejecting characteristic and obtaining a stable liquid ejecting characteristic.

A first aspect of the present invention for attaining the foregoing object is a liquid-jet recording head having a passage-forming substrate in which pressure generating chambers to communicate with nozzle orifices is formed, and piezoelectric elements provided on one side of the passage-forming substrate through a vibration plate so as to generate pressure changes inside the pressure generating chambers. Here, the liquid-jet recording head includes: an insulation layer which is continuously provided at least in a region opposing to the vicinity of longitudinal end portions of the piezoelectric elements along a direction of arrangement of the piezoelectric elements, the insulation layer also having a penetrated portion in a region opposing to a common electrode provided in common to the plurality of piezoelectric elements; and a connective wiring layer which is continuously provided on the insulation layer to be electrically connected to the common electrode through the penetrated portion.

In the first aspect, a resistance value of the common electrode is substantially reduced by the connective wiring layer. Accordingly, a voltage drop in the event of driving the piezoelectric element is prevented, and a liquid ejecting characteristic is always retained favorably. Moreover, providing the insulation layer allows continuous formation of the connective wiring layer in the region opposing to the piezoelectric elements. Therefore, it is possible to form the connective wiring layer in a desired size without increasing the size of the head.

A second aspect of the present invention is the liquid-jet recording head according to the first aspect, in which the penetrated portions are provided on the insulation layer in regions opposing to compartment walls partitioning the pressure generating chambers, respectively.

In the second aspect, the virtual resistance value of the common electrode becomes approximately uniform as a whole because the common electrode and the connective wiring layer are electrically connected to each other with a given interval. Therefore, unevenness in the liquid ejecting characteristics among the nozzle orifices is prevented.

A third aspect of the present invention is the liquid-jet recording head according to any one of the first and the second aspects, in which the insulation layer in a region opposing to the pressure generating chamber is removed.

In the third aspect, displacement of the vibration plate upon driving the piezoelectric element is not blocked by the insulation layer, and the liquid ejecting characteristic is retained favorably.

A fourth aspect of the present invention is the liquid-jet recording head according to any one of the first to third aspects, in which an extraction electrode which is drawn out of an individual electrode of the piezoelectric element extends to the vicinity of an end portion of the passage-forming substrate, and at least a position close to a tip portion of the extraction electrode includes an exposed portion where a surface is exposed by removing the insulation layer and the connective wiring layer.

In the fourth aspect, each extraction electrode is electrically connected to a driver IC for driving the piezoelectric element at this exposed portion.

A fifth aspect of the present invention is the liquid-jet recording head according to the fourth aspect, in which the exposed portion of the extraction electrode is made of the same layer as the connective wiring layer and is electrically connected to an independent wiring layer respectively which is independent of the connective wiring layer.

In the fifth aspect, the liquid ejecting characteristic becomes certainly more stable because the resistance value of each extraction electrode is substantially reduced.

A sixth aspect of the present invention is the liquid-jet recording head according to the fifth aspect, in which the exposed portion of the extraction electrode is covered with the independent wiring layer.

In the sixth aspect, it is possible to prevent the extraction electrode from removal in the event of patterning the connective wiring layer.

A seventh aspect of the present invention is the liquid-jet recording head according to any one of the fourth to sixth aspects further including a laminated electrode layer which is provided on the common electrode in a region corresponding to the outside of an array of the pressure generating chambers, the laminated electrode layer being made of the same layer as the extraction electrode and provided independently of the extraction electrode. Here, the laminated electrode layer is electrically connected to the connective wiring layer.

In the seventh aspect, the resistance value of the common electrode can be further reduced by the laminated electrode layer, and the liquid ejecting characteristic becomes certainly more stable.

An eighth aspect of the present invention is the liquid-jet recording head according to any one of the first to seventh aspects, in which the insulation layer is made of photosensitive resin.

In the eighth aspect, it is possible to form the insulation layer relatively easily and with high accuracy.

A ninth aspect of the present invention is the liquid-jet recording head according to the eighth aspect, in which the photosensitive resin is polyimide resin.

In the ninth aspect, it is possible to form the insulation layer with high insulation property relatively easily by use of the given photosensitive resin.

A tenth aspect of the present invention is the liquid-jet recording head according to any one of the first to seventh aspects, in which the insulation layer is made of any one of fluorocarbon resin, silicone resin, epoxy resin, silicon oxide, silicon nitride, and tantalum oxide.

In the tenth aspect, it is possible to form the insulation layer with high insulation property relatively easily by use of the given material.

An eleventh aspect of the present invention is the liquid-jet recording head according to any one of the first to tenth aspects, in which the common electrode has a film thickness of 0.5 $\mu$m or less.

In the eleventh aspect, a favorable liquid ejecting characteristic is always obtained even if the film thickness of the common electrode is relatively thin.

A twelfth aspect of the present invention is the liquid-jet recording head according to any one of the first to eleventh aspects, in which the pressure generating chamber is formed on a single crystal silicon substrate by anisotropic etching, and the respective layers of the piezoelectric element are formed by a film-forming method and a lithography method.

In the twelfth aspect, it is possible to manufacture the liquid-jet recording heads with high-density nozzle orifices relatively easily and in high quantity.

A thirteenth aspect of the present invention is a liquid-jet recording apparatus including the liquid-jet recording head according to any one of the first to twelfth aspects.

In the thirteenth aspect, it is possible to realize the liquid-jet recording apparatus with a stable liquid ejecting characteristic and enhanced reliability.

DETAILED DESCRIPTION OF THE PREFERRED EMBODIMENTS

Now, the present invention will be described in detail based on embodiments.

(First Embodiment)

Figure 1:
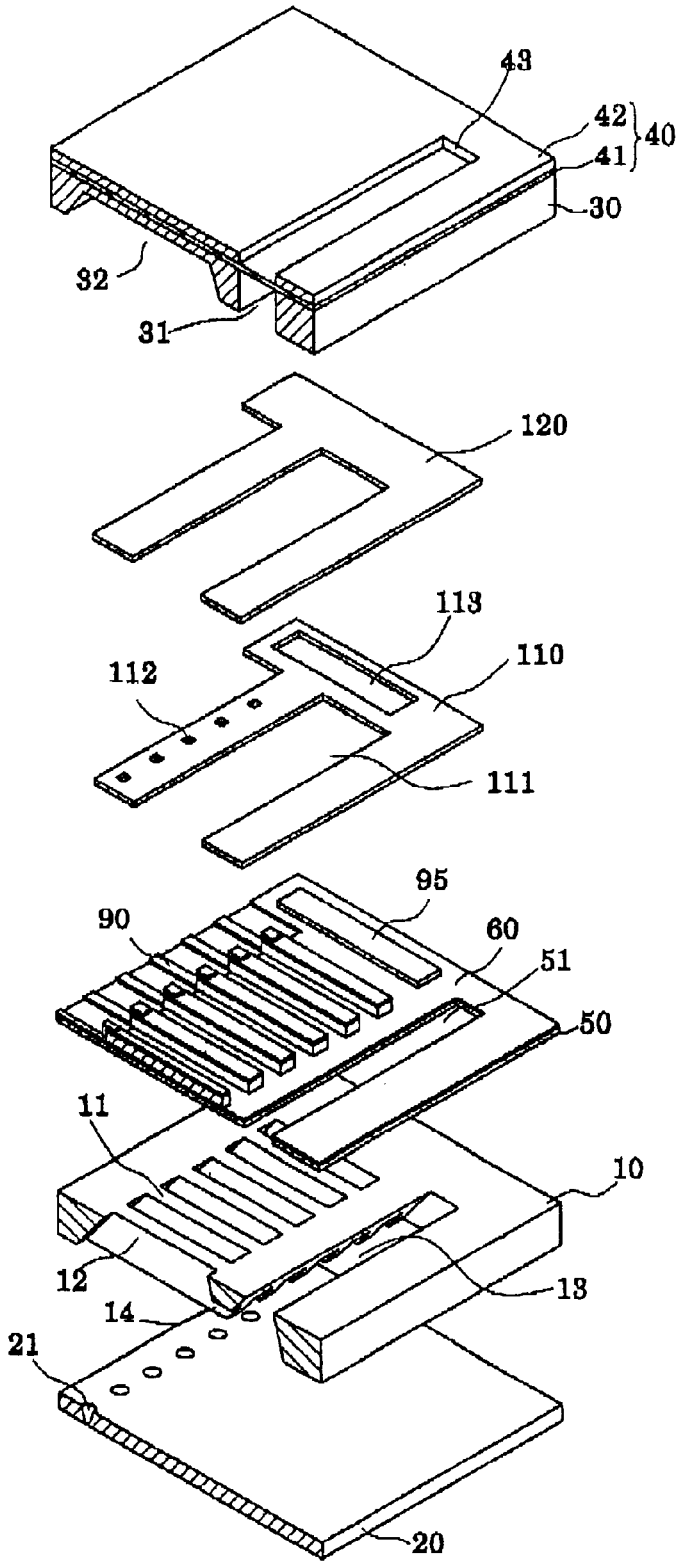
FIG. 1 is an exploded perspective view of an ink-jet recording head according to a first embodiment of the present invention.
Figure 2A:
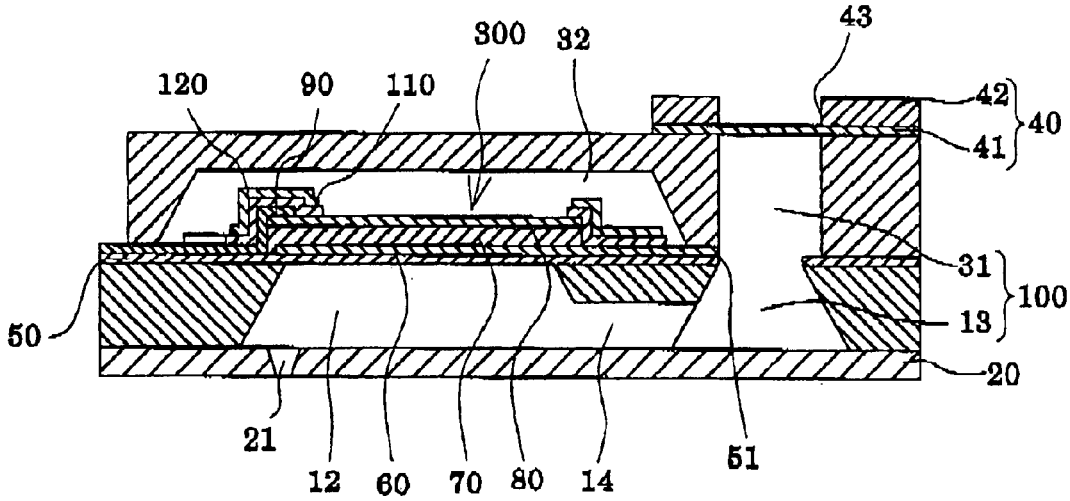
FIGS. 2(*a*) and 2(*b*) are cross-sectional views of the ink-jet recording head according to the first embodiment of the present invention.
Figure 2B:
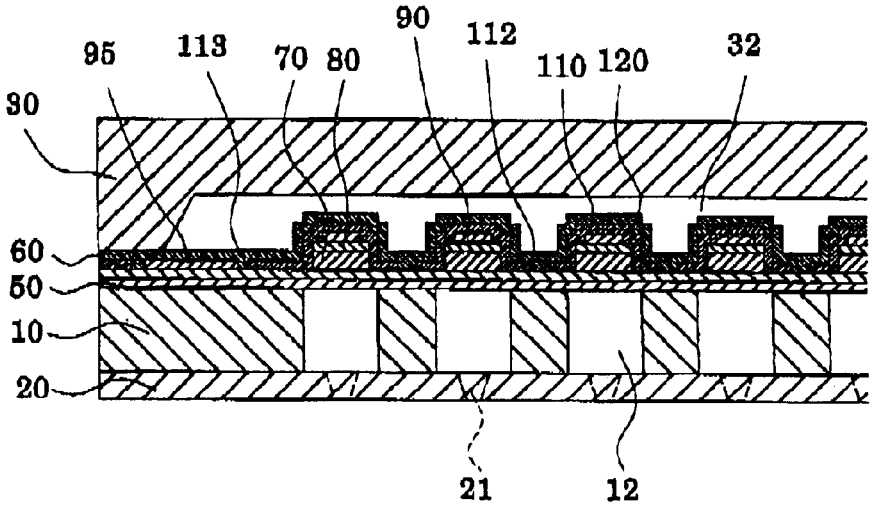
Figure 3:
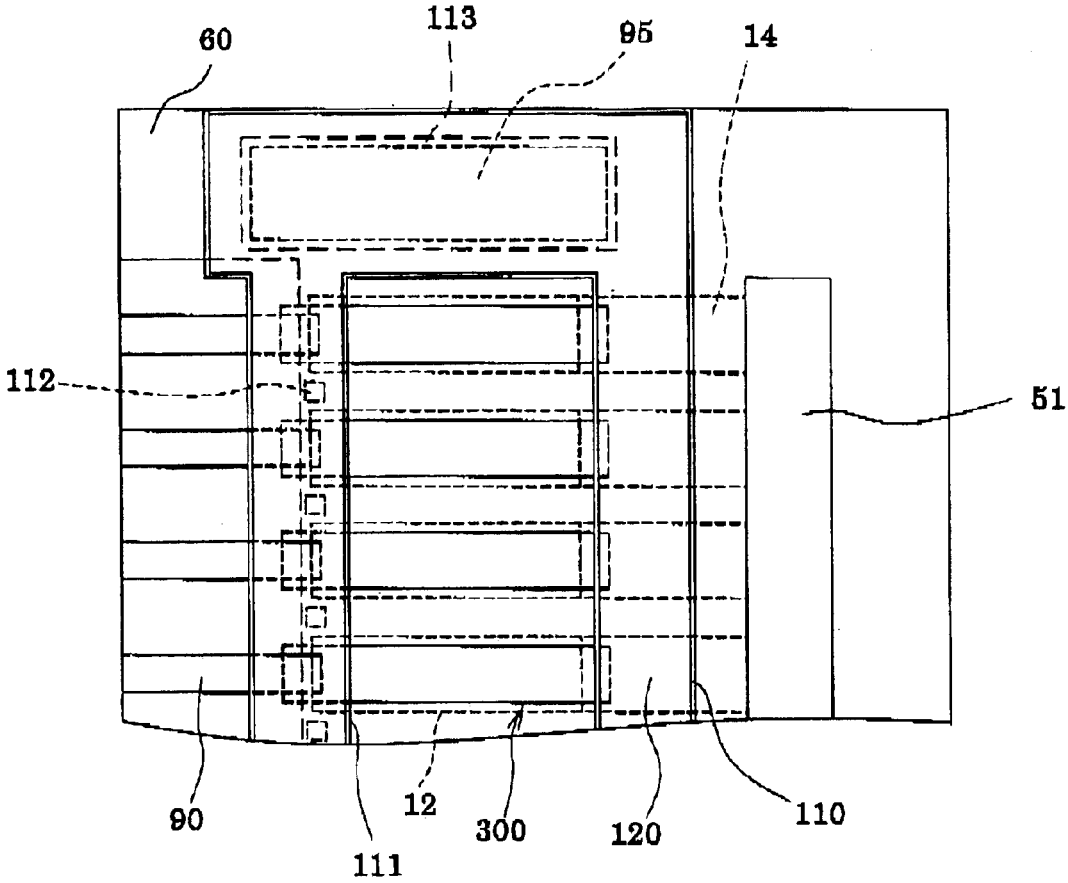
FIG. 3 is a plan view showing a wiring structure of the ink-jet recording head according to the first embodiment.

FIG. 1 is an exploded perspective view of an ink-jet recording head according to a first embodiment of the present invention. FIGS. 2(*a*) and 2(*b*) are cross-sectional views of FIG. 1, and FIG. 3 is a plan view showing a wiring structure of the ink-jet recording head according to the first embodiment.

As illustrated therein, a passage-forming substrate 10 is made of a single crystal silicon substrate having a plane orientation (110) in this embodiment. On one surface thereof, a plurality of pressure generating chambers 12 formed by anisotropic etching are arranged side by side along a width direction thereof. Moreover, on the outside in the longitudinal direction of the pressure generating chambers 12, there is formed a communicating portion 13 constituting part of a reservoir, which communicates with a reservoir portion 31 of a reservoir forming plate 30 to be described later and thereby includes a common ink chamber to the respective pressure generating chambers 12. The communicating portion 13 communicates with a longitudinal end of each pressure generating chamber 12 respectively through an ink supply path 14.

Moreover, one of the surfaces of this passage-forming substrate 10 includes an opening surface, and on the other surface there is formed an elastic film 50 in the thickness of 1 to 2 μm made of silicon dioxide being formed by thermal oxidation.

Here, anisotropic etching is performed by use of a difference in etching rates on the single crystal silicon substrate. For example, in this embodiment, anisotropic etching is performed by use of the following property that the single crystal silicon substrate is gradually eroded when immersed in an alkaline solution such as KOH, whereby there develop a first (111) plane being perpendicular to the (110) plane and a second (111) plane forming an angle of about 70 degrees with this first (111) plane and forming an angle of about 35 degrees with the (110) plane, and that the etching rate on the (111) planes is about 1/180 as compared to the etching rate on the (110) plane. By adoption of such anisotropic etching, high-precision processing becomes feasible based on depth processing of a parallelogram shape formed by two first (111) planes and two oblique second (111) planes. Accordingly, it is possible to arrange the pressure generating chambers 12 in high density.

In this embodiment, long sides of each pressure generating chamber 12 are formed of the first (111) planes and short sides thereof are formed of the second (111) planes. This pressure generating chamber 12 is formed by etching so as to almost penetrate the passage-forming substrate 10 until reaching the elastic film 50. Here, the elastic film 5 is hardly eroded by the alkaline solution for etching the single crystal silicon substrate. Moreover, each ink supply path 14 which communicates with one end of each pressure generating chamber 12 is formed shallower than the pressure generating chamber 12, and thereby maintains constant passage resistance of the ink flowing into the pressure generating chamber 12. In other words, the ink supply path 14 is formed by etching the single crystal silicon substrate halfway in the thickness direction (half-etching). Note that such half-etching is achieved by adjustment of etching time.

Here, regarding the thickness of the passage-forming substrate 10 to be formed with such pressure generating chambers 12 and the like, it is preferable that an optimal thickness is selected in accordance with the density of arranging the pressure generating chambers 12. For example, in the case of arranging the pressure generating chambers 12 in line with some 180 dots per inch (180 dpi), the thickness of the passage-forming substrate 10 is preferably set to about 180 to 280 μm, or more preferably to about 220 μm. Meanwhile, in the case of arranging the pressure generating chambers 12 relatively in high density of some 360 dpi, for example, the thickness of the passage-forming substrate 10 is preferably set to 100 μm or below. In this manner, it is possible to increase the arrangement density while maintaining rigidity of compartment walls between adjacent pressure generating chambers 12.

Moreover, a nozzle plate 20 is fixed to an opening surface side of the passage-forming substrate 10 with an adhesive agent or a thermowelding film. Here, the nozzle plate 20 includes nozzle orifices 21, which are drilled to communicate with the respective pressure generating chambers 12 on an opposite side to the side where the respective pressure generating chambers 12 communicate with the ink supply paths 14. Note that the nozzle plate 20 is made of glass ceramics, rust-proof steel or the like, which has a thickness in a range from 0.1 to 1 mm and a linear expansively from 2.5 to $4.5\times10^{-6}$/° C. at a temperature of 300° C. or below, for example. The nozzle plate 20 covers the entire surface of the passage-forming substrate 10 with one plane thereof, whereby the nozzle plate 20 also functions as a reinforcing plate for protecting the single crystal silicon substrate against impacts or external forces, Meanwhile, it is also possible to form the nozzle plate 20 by use of a material having a coefficient of thermal expansion almost the same as that of the passage-forming substrate 10. In this case, degrees of deformation of the passage-forming substrate 10 and the nozzle plate 20 with heat become almost equivalent to each other. Accordingly, it is possible to join the both members easily by use of a thermosetting adhesive agent or the like.

Here, the size of the pressure generating chamber 12 for dispersing ink-droplet ejecting pressure to ink and the size of the nozzle orifice 21 for ejecting ink droplets are optimized in accordance with an amount of ink droplets to be ejected, an ejecting speed, and an ejecting frequency. For example, in the case of recording 360 dots of ink droplets per inch, the nozzle orifices 21 need to be formed accurately so as to have diameters of tens of micrometers.

Meanwhile, a lower electrode film 60 in a thickness of about 0.2 μm, for example, a piezoelectric layer 70 in a thickness of about 1 μm, for example, and an upper electrode film 80 in a thickness of about 0.1 μm, for example, are formed on the elastic film 50 provided on the opposite side to the opening surface of the passage-forming substrate 10 by lamination in accordance with a process to be described later, whereby a piezoelectric element 300 is included. Here, the piezoelectric element 300 refers to a portion including the lower electrode film 60, the piezoelectric layer 70 and the upper electrode film 80. In general, the piezoelectric element 300 is constituted by setting one of the electrodes thereof as a common electrode, while the other electrode and the piezoelectric layer 70 are patterned by each pressure generating chamber 12. Moreover, a portion composed of one of the electrodes and the piezoelectric layer 70 thus patterned, the portion causing piezoelectric distortion upon application of voltage to the both electrodes, is hereinafter referred to as a piezoelectric active portion. In this embodiment, the lower electrode film 60 is defined as the common electrode of the piezoelectric element 300 and the upper electrode film 80 is defined as an individual electrode of the piezoelectric element 300. However, there is no obstacle in inverting such definitions due to a reason attributable to drive circuits or wiring designs. In any case, a piezoelectric active portion will be formed on each pressure generating chamber. Furthermore, the piezoelectric element 300, and a vibration plate to be displaced by the drive of the piezoelectric element 300 are hereinafter collectively referred to as a piezoelectric actuator.

Here, an extraction electrode 90 is connected to each upper electrode film 80 which is the individual electrode of the piezoelectric element 300. Here, the extraction electrode 90 is made of gold (Au) and the like, for example, and extends from the vicinity of an end portion on the opposite side to the ink supply path 14 to the vicinity of an end portion of the passage-forming substrate 10. Moreover, although it is not illustrated in the drawings, external wiring which leads to a driver circuit for driving the piezoelectric element 300 is connected to the vicinity of a tip portion of this extraction electrode 90.

Meanwhile, the lower electrode film 60 which is the common electrode to the piezoelectric elements 300 is provided so as to extend continuously across the direction of arrangement of the pressure generating chambers 12. The lower electrode film 60 is also patterned in the vicinity of an end portion on the opposite side to the ink supply paths 14 of the pressure generating chambers 12. That is to say, in this embodiment, the lower electrode film 60 is removed only in an after-mentioned region of the passage-forming substrate 10 where the extraction electrodes 90 are extended, and is provided on the entire surface of the passage-forming substrate 10 in the remaining region.

Moreover, in this embodiment, a laminated electrode layer 95 is provided on the lower electrode film 60 in a region corresponding to the outside of an array of the pressure generating chambers 12. Here, the laminated electrode layer 95 is made of the same layer as the extraction electrodes 90 but is independent of the extraction electrodes 90.

In addition, an insulation layer 110 is provided in a region opposing to the vicinity of the longitudinal end portions of the piezoelectric elements 300. Here, the insulation layer 110 is made of an insulating material and extends along the direction of arrangement of the piezoelectric elements 300. For example, in this embodiment, the insulation layer 110 is provided continuously around the array of the pressure generating chambers 12, and the region corresponding to the array of the pressure generating chambers 12 is formed as an opening portion 111.

Moreover, a Connective wiring layer 120 made of a conductive material is continuously provided on this insulation layer 110. This connective wiring layer 120 is electrically connected to the lower electrode film 60 via a plurality of penetrated portions 112 provided on the insulation layer 110.

Here, it is preferable that the penetrated portions 112 to be provided on the insulation layer 110 are disposed at relatively even intervals. For example, in this embodiment, each penetrated portion 112 is provided in a region opposing to each compartment wall 11 of the insulation layer 110 which extends in the vicinity of the end portion on the extraction electrode 90 side of each piezoelectric element 300. Although the size of the penetrated portion 112 is not particularly limited, however, it is preferably set to 20 $\mu$m or below.

Moreover, a penetrated portion 113 is also provided in a region opposing to the outside of the array of the pressure generating chambers 12, i.e. the region opposing to the laminated electrode layer 95 provided on the lower electrode film 60. The laminated electrode layer 95 (the lower electrode film 60) is electrically connected to the connective wiring layer 120 via this penetrated portion 113 as well.

In this way, a resistance value of the lower electrode film 60 is substantially reduced by electrically connecting the connective wiring layer 120 to the lower electrode film 60 which is the common electrode of the piezoelectric element 300. Similarly, the resistance value of the lower electrode film 60 is substantially reduced also by providing the laminated electrode layer 95 on the lower electrode film 60. Therefore, a voltage drop does not occur even it many piezoelectric elements are driven simultaneously, whereby a favorable and stable ink ejecting characteristic is always obtained.

Moreover, since the connective wiring layer 120 is provided in the region opposing to the end portion of the piezoelectric element 300 via the insulation layer 110, it is not necessary to reserve a space for providing the connective wiring layer 120. Therefore, it is possible to stabilize the ink ejecting characteristic without the increase of the size of the head.

Furthermore, since the connective wiring layer 120 are electrically connected to the lower electrode film 60 via the plurality of penetrated portions 112 and 113 on the insulation layer 110, the resistance values at various portions on the lower electrode film 60 are made approximately equal, whereby an amount of displacement of the vibration plate by the drive of each piezoelectric element 300 is stabilized. In this way, it is possible to equalize the ink ejecting characteristics of the ink which is ejected from the respective nozzle orifices.

Moreover, in this embodiment, since the insulation layer 110 and the connective wiring layer 120 are provided outside the region opposing to the array of the pressure generating chambers 12, displacement of the vibration plate is not inhibited by the connective wiring layer 120, Therefore, the connective wiring-layer 120 can be made relatively thicker, whereby the resistance value of the lower electrode film 60 can be surely reduced.

Figure 4:
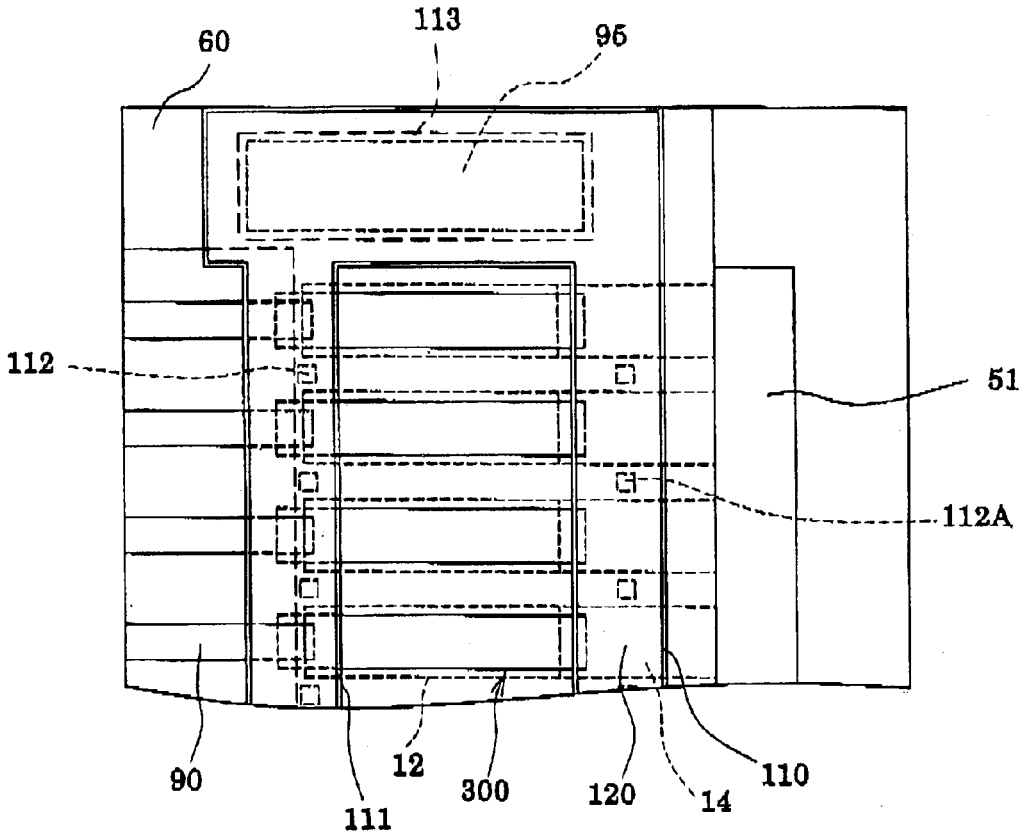
FIG. 4 is a plan view showing a modified example of the wiring structure of the ink-jet recording head according to the first embodiment of the present invention.

Note that each penetrated portion 112 is provided in the region opposing to each compartment wall 11 of the insulation layer 110 which extends to the vicinity of the end portions on the side of the extraction electrodes 90 of the respective piezoelectric elements 300 in this embodiment. However, the number and positions of the penetrated portions 112 are not particularly limited. For example, as shown in FIG. 4, penetrated portions 112A may be provided at given intervals on the insulation layer 110 extended to the vicinity of end portions of the piezoelectric elements 300 on the opposite side to the extraction electrodes 90.

Figure 5:
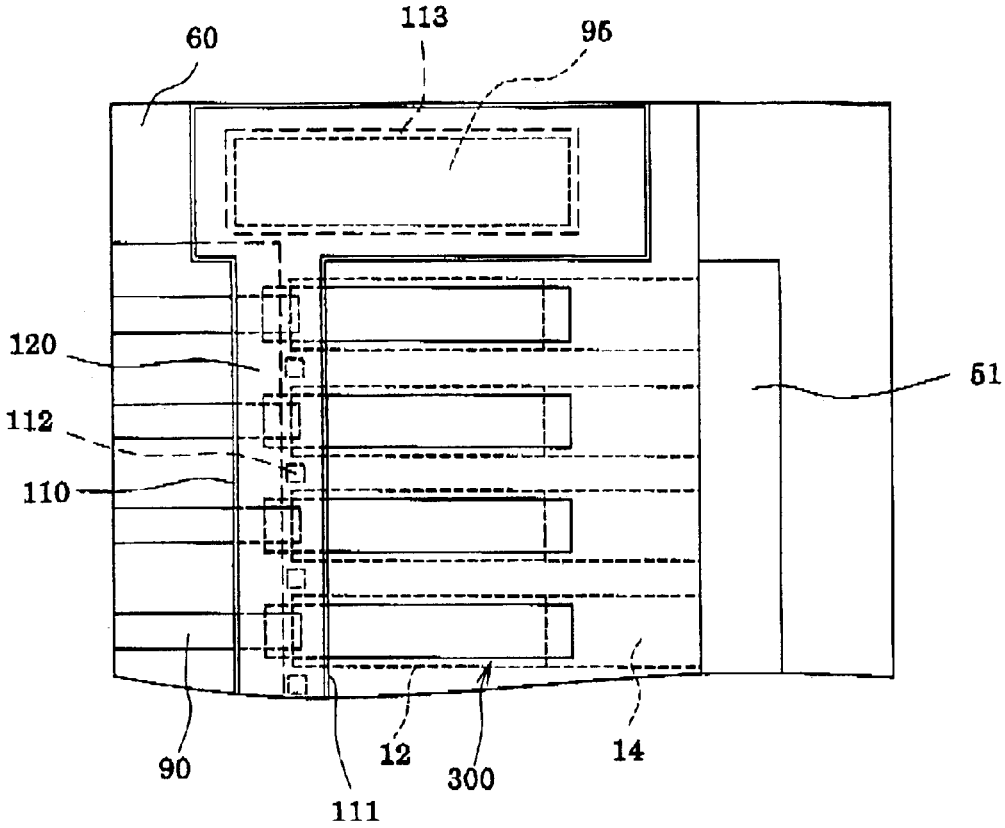
FIG. 5 is a plan view showing another modified example of the wiring structure of the ink-jet recording head according to the first embodiment of the present invention.

Moreover, the region for providing the connective wiring layer 120 is not particularly limited, either. The region for providing the connective wiring layer 120 should be appropriately decided in consideration of conditions such as the resistance value of the lower electrode film 60. For example, as shown in FIG. 5, the connective wiring layer 120 may be provided only in the region opposing to the vicinity of the end portions on the side of the extraction electrodes 90 of the piezoelectric elements 300 and in the region opposing to the outside of the array of the pressure generating chambers 12.

Figure 6:
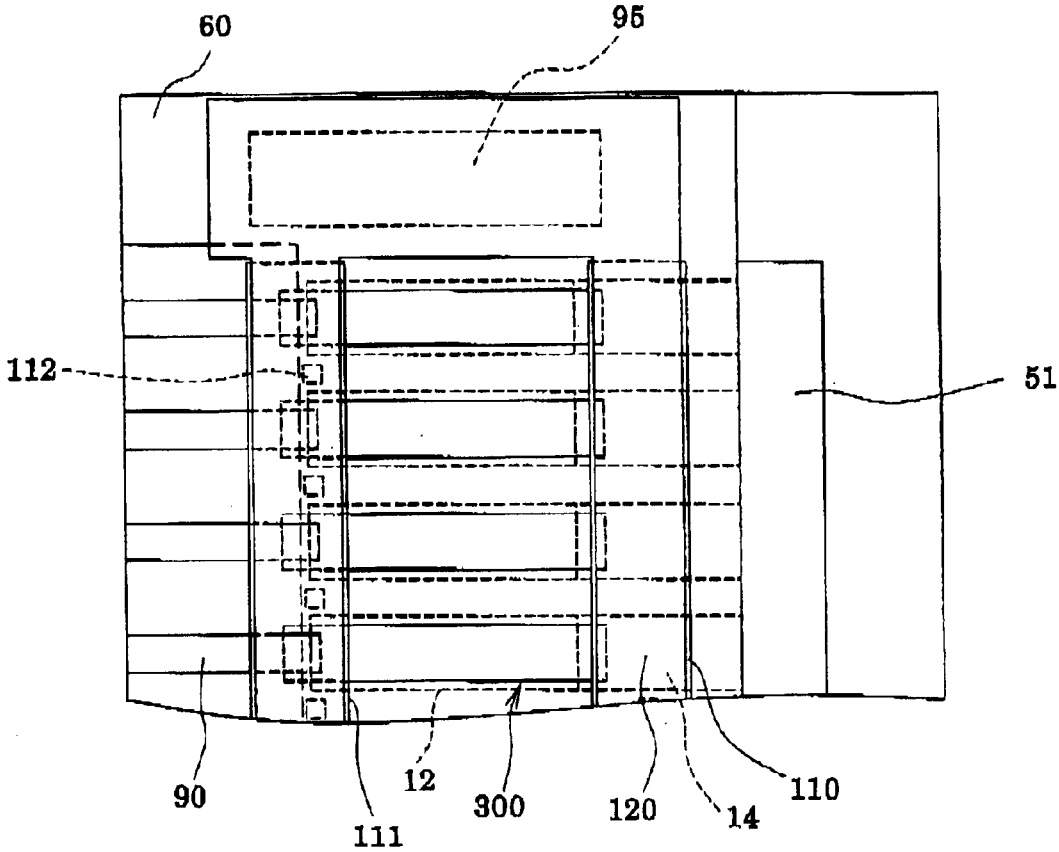
FIG. 6 is a plan view showing still another modified example of the wiring structure of the ink-jet recording head according to the first embodiment of the present invention.
Figure 7A:
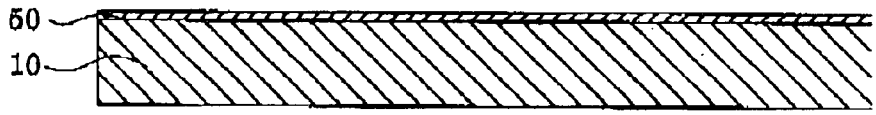
FIGS. 7(*a*) to 7(*e*) are cross-sectional views showing manufacturing process of the ink-jet recording head according to the first embodiment of the present invention.
Figure 7B:
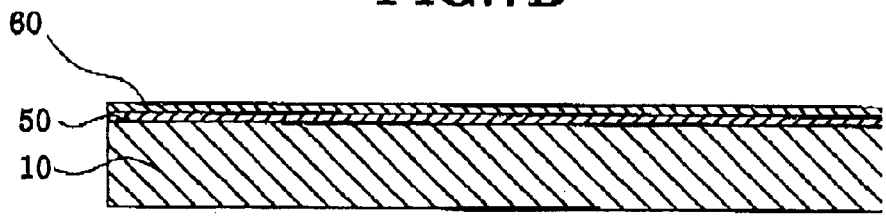
Figure 7C:
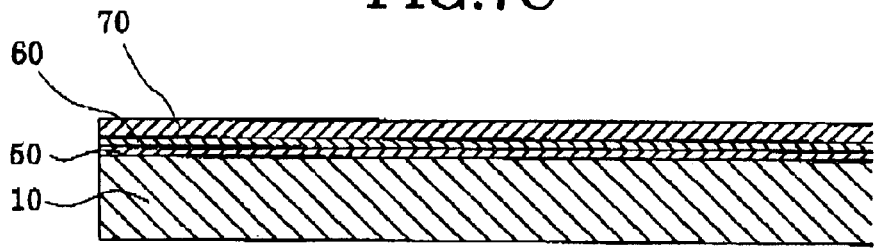
Figure 7D:
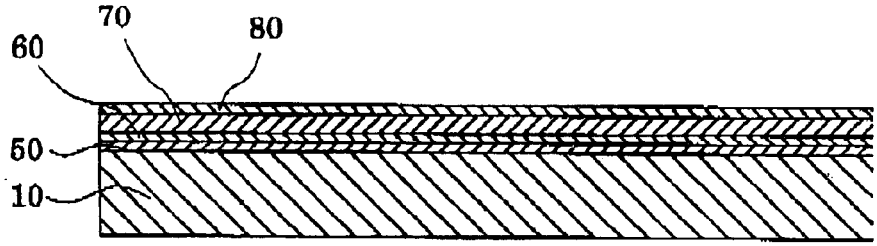
Figure 7E:
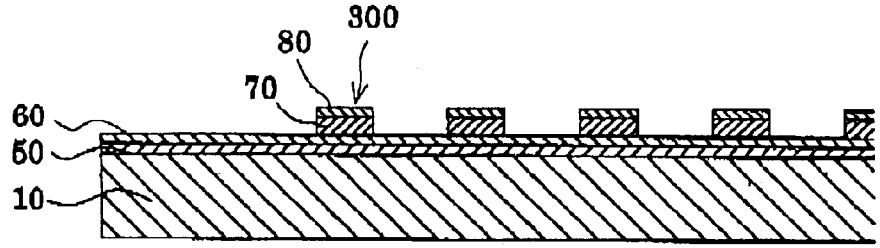
Figure 8A:
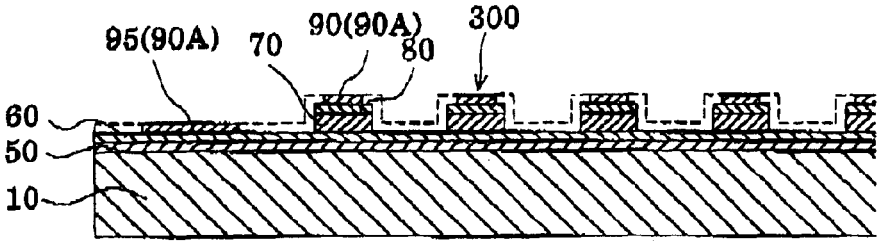
FIGS. 8(*a*) to 8(*d*) are cross-sectional views showing the manufacturing process, of the ink-jet recording head according to the first embodiment of the present invention.
Figure 8B:
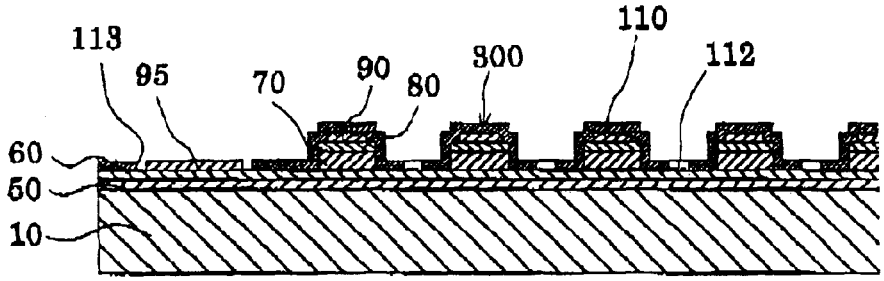
Figure 8C:
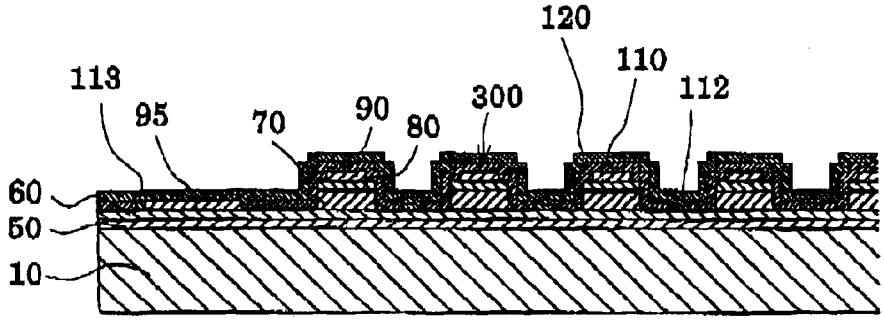
Figure 8D:
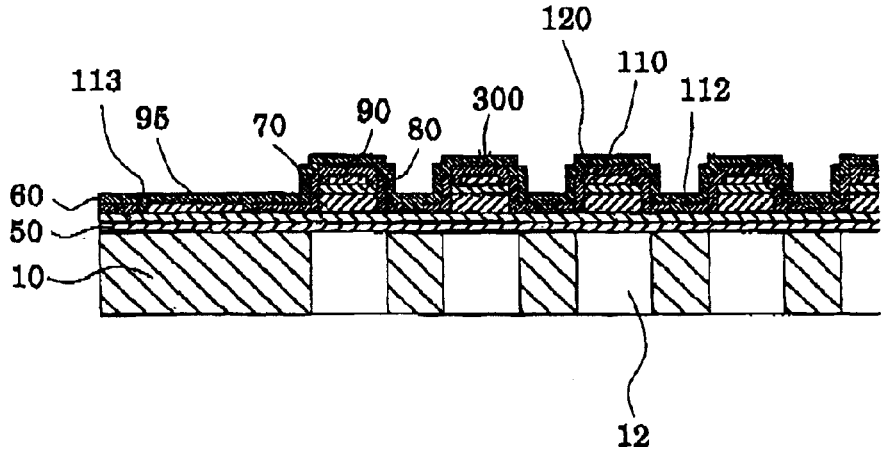

Furthermore, the insulation layer 110 is provided to prevent short circuits between the lower electrode film 60 and the upper electrode film 80, in other words, to prevent electrical contact of the connective wiring layer 120 to the upper electrode film 80 and the extraction electrode 90. Therefore, although the insulation layer 110 is also provided in the region opposing to the outside of the array of the pressure generating chambers 12 in this embodiment, it is satisfactory if the insulation layer 110 is provided at least in the region corresponding to the vicinity of the longitudinal end portions of the piezoelectric elements 300 as shown in FIG. 6.

Note that a reservoir-forming plate 30, which includes a reservoir portion 31 that includes at least part of a reservoir 100 serving as a common ink chamber to the respective pressure generating chambers 12, is joined to the passage-forming substrate on the side of the piezoelectric elements 300. In this embodiment, this reservoir portion 31 penetrates the reservoir-forming plate 30 in the thickness direction and is formed across the width direction of the pressure generating chambers 12. Moreover, the reservoir-forming plate 30 communicates with the communicating portion 13 of the passage-forming substrate 10 via a penetrated hole 51 provided by penetrating the elastic film 50, thereby constituting the reservoir 100 which serves as the common ink chamber to the respective pressure generating chambers 12.

As for the reservoir-forming plate 30, it is preferable to use a material having approximately the same coefficient of thermal expansion as that of the passage-forming substrate 10 such as glass, a ceramic material or the like. In this embodiment, the reservoir-forming plate 30 is formed by use of a single crystal silicon substrate, which is the same material as the passage-forming substrate 10.

Moreover, a piezoelectric element holding portion 32 is provided in a region opposing to the piezoelectric elements 300 of the reservoir-forming plate 30 in the state of securing a space to the extent not to interfere with movement of the piezoelectric elements 300. The piezoelectric elements 300 are tightly sealed inside this piezoelectric element holding portion 32.

Moreover, a compliance plate 40 composed of a sealing film 41 and a fixing plate 42 is joined to the reservoir-forming plate 30. Here, the sealing film 41 is made of a material having low rigidity and high flexibility (such as a polyphenylene sulfide (PPS) film in a thickness of 6 $\mu$m). One side of the reservoir portion 31 is sealed by this sealing film 41. Meanwhile, the fixing plate 42 is made of a hard material of metal or the like (such as stainless steel (SUS) in a thickness of 30 $\mu$m). A region of the fixing plate 42 opposing to the reservoir 100 is completely removed in the thickness direction so as to include an opening portion 43. Accordingly, one side of the reservoir 100 is sealed only by the flexible sealing film 41.

The ink-jet recording head in this embodiment intakes ink from unillustrated external ink supplying means, whereby the ink is filled to the inside ranging from the reservoir 100 to the nozzle orifices 21. Thereafter, voltage is applied between the lower electrode film 60 and the upper electrode film 80 corresponding to each pressure generating chamber 12 via external wiring in accordance with a recording signal from an unillustrated external driver circuit, whereby the elastic film 50, the lower electrode film 60, and the piezoelectric layer 70 are subjected to flexure deformation. In this way, pressure inside each of the pressure generating chambers 12 is increased and the ink droplets are thereby ejected from the nozzle orifice 21.

Now, description will be made regarding an example of a method of manufacturing the ink-jet recording head of this embodiment with reference to FIG. 7(*a*) to FIG. 8(*d*). Note that FIG. 7(*a*) to FIG. 8(*d*) are cross-sectional views showing part of the pressure generating chamber 12 along the width direction thereof.

First, as shown in FIG. 7(*a*), a single crystal silicon substrate to be formed into the passage-forming substrate 10 is subjected to thermal oxidation in a diffusion furnace at a temperature of about 1100° C., thus forming the elastic film 50 made of silicon dioxide.

Next, as shown in FIG. 7(*b*), the lower electrode film 60 is formed on the entire surface of the elastic film 50, and then the lower electrode film 60 is patterned to form an entire pattern. Here, platinum (Pt) or the like is suitable for the material of this lower electrode film 60. It is because the after-mentioned piezoelectric layer 70 to be formed into a film by a sputtering method or a sol-gel method needs to be crystallized at a temperature in a range from about 600° C. to 1000° C. under an atmosphere of air or oxygen after film-forming. That is, the material for the lower electrode film 60 must retain conductivity at such high temperature and under an oxidation atmosphere. In particular, when lead zirconate titanate (PZT) is used as the piezoelectric layer 70, it is preferable that the lower electrode film 60 changes its conductivity as little as possible by diffusion of lead oxide. Platinum is preferable due to these reasons.

Next, the piezoelectric layer 70 is formed into a film as shown in FIG. 7(*c*). It is preferable that the crystal of this piezoelectric layer 70 is oriented. For example, in this embodiment, the piezoelectric layer having the oriented crystal is formed by use of a so-called sol-gel method. Here, the sol-gel method includes the steps of dissolving/dispersing organic metal in a solvent, coating, drying to form gel, and baking the gel at a high temperature to obtain the piezoelectric layer 70 made of metal oxide, As the material for the piezoelectric layer 70, a material in a lead zirconate titanate group is preferred for use in an ink-jet recording device. Note that the method of film-forming this piezoelectric layer 70 is not particularly limited and the piezoelectric layer 70 may be formed by a sputtering method, for example.

In addition, it is also possible to use a method including a step of forming a lead zirconate titanate precursor film by a sol-gel method, a sputtering method or the like, and a step of growing crystal at a low temperature by a high pressure process in an aqueous alkaline solution.

In any case, the piezoelectric layer 70 thus formed has the crystal subjected to priority orientation unlike a bulk piezoelectric material. Moreover, in the present embodiment, the piezoelectric layer 70 has the crystal formed into a columnar shape. Note that the priority orientation refers to a state where the direction of orientation of the crystal is not in disorder but a specific crystal plane of the crystal is oriented approximately to a fixed direction. In addition, a thin film having a crystal in a columnar shape refers to a state of forming a thin film, in which crystals having approximately columnar shapes are gathered across the surface direction while center axes thereof are coincided approximately with the thickness direction. It is a matter of course that the piezoelectric layer 70 may be a thin film formed of particle-shaped crystals subjected to the priority orientation. Note that a thickness of a piezoelectric layer thus manufactured in the thin film process is generally in a range from 0.2 to 5 $\mu$m.

Next, the upper electrode film 80 is formed into a film as shown in FIG. 7(*d*). It is essential only that the upper electrode film 80 is made of a highly conductive material, therefore many kinds of metal such as aluminum, gold, nickel and platinum, conductive oxides, and the like can be used. In this embodiment, platinum is formed into a film by sputtering.

Next, as shown in FIG. 7(*e*), patterning of the piezoelectric elements 300 is performed by etching only the piezoelectric layer 70 and the upper electrode film 80.

Next, the extraction electrodes 90 and the laminated electrode layer 95 are formed as shown in FIG. 8(*a*). In this embodiment, a metallic film 90A made of gold (Au) or the like to include the extraction electrodes 90, for example, is formed on the entire surface of the passage-forming substrate 10 and then this metallic film 90A is patterned to form the respective extraction electrodes 90 for the respective piezoelectric elements 300. Meanwhile, in this event, the metallic film 90A in the region opposing to the outside of the array of the pressure generating chambers 12 is left to form the laminated electrode layer 95.

Next, as shown in FIG. 8(*b*), the insulation layer 110 is formed around the array of the pressure generating chambers 12 and the penetrated portions 112 and 113 are formed in given positions. Specifically, after forming the insulation layer 110 on the entire surface of the passage-forming substrate 10, the opening portion 111 (not illustrated) and the penetrated portions 112 and 113 are formed by etching to include a given pattern.

As for the material of this insulation layer 110, it is preferable to use photosensitive resin such as polyimide. In this way, it is possible to form the insulation layer 110 relatively easily and with high accuracy. Moreover, the material for the insulation layer 110 is not particularly limited as long as the material has relatively high insulation property. For example, it is also possible to use fluorocarbon resin, silicone resin, epoxy resin, silicon oxide, silicon nitride, tantalum oxide, or the like.

Next, the connective wiring layer 120 is formed on the insulation layer 110 as shown in FIG. 8(*c*). Specifically, after forming the connective wiring layer 120 on the entire surface of the passage-forming substrate 10, a given pattern is formed by etching.

As described previously, this connective wiring layer 120 also functions to reduce the resistance value of the lower electrode film 60. Accordingly, it is preferable to use metal at least having smaller resistivity than that of the lower electrode film 60. For example, such metal includes gold (Au), copper (Cu), aluminum (Al), and the like. For example, the connective wiring layer 120 is formed by sputtering gold (Au) in this embodiment.

Figure 9A:
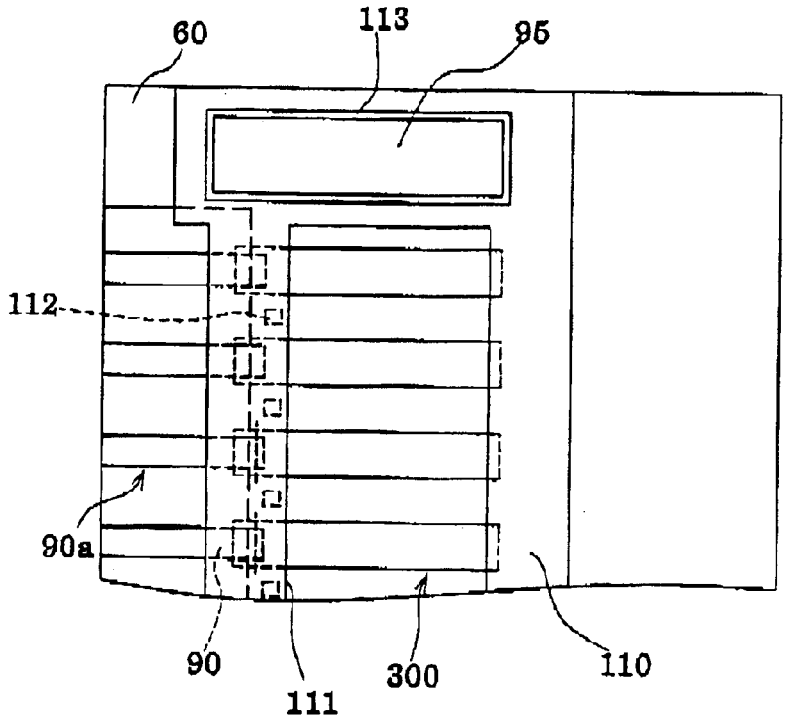
FIGS. 9(*a*) and 9(*b*) are plan views showing a modified example of the manufacturing process of the ink-jet recording head according to the present invention.
Figure 9B:
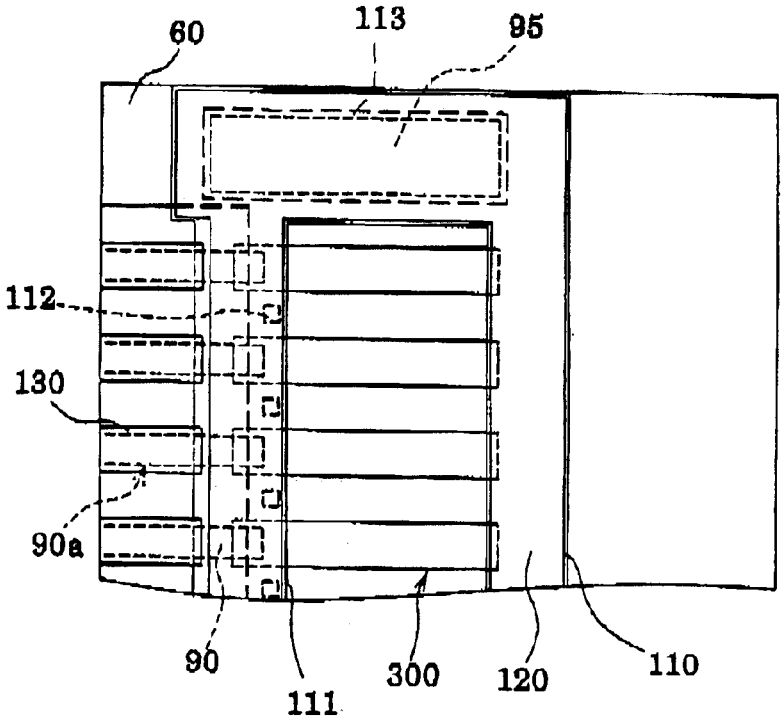

Here, upon forming the connective wiring layer 120, the insulation layer 110 is removed in the vicinity of the tip portions of the extraction electrodes 90, thereby constituting exposed portions 90*a* with exposed surfaces as shown in FIG. 9(*a*) Therefore, patterning of the connective wiring layer 120 may simultaneously cause patterning of the exposed portions 90*a* of the extraction electrodes 90. For this reason, upon patterning the connective wiring layer 120, it is also possible to leave independent wiring layers 130 in regions opposing to the exposed portions 90*a* of the extraction electrodes 90 and being independent of the connective wiring layer 120 as shown in FIG. 9(*b*).

The size of this independent wiring layer 130 is not particularly limited, however, it is preferable that the independent wiring layer 130 covers the exposed portion 90*a* and is formed into approximately the same shape as the exposed portion 90*a*. In this way, it is possible to avoid the exposed portion 90*a* of the extraction electrode 90 from removal in the event of forming the connective wiring layer 120. In addition, it is also possible to avoid short-circuits of the respective extraction electrodes 90.

Description has been made regarding the film-forming process as described above. After forming the films, the single crystal silicon substrate is subjected to anisotropic etching with the aqueous alkaline solution as described previously. In this way, the pressure generating chambers 12, and the like are formed as shown in FIG. 8(*d*).

As a matter of fact, a lot of chips are formed simultaneously on one wafer by the above-described series of film-forming process and anisotropic etching. After completion of the process, the wafer is divided into the passage-forming substrates 10 of the same chip size as shown in FIG. 1. Thereafter, the reservoir-forming plate 30 and the compliance plate 40 are sequentially adhered to the divided passage-forming substrate 10 for integration. In this way, the ink-jet recording head is completed.

(Other Embodiments)

Although description has been made regarding one embodiment of the present invention, it is to be understood that the constitution of the present invention shall not be limited to those expressly stated above.

For example, the laminated electrode layer 95 is provided on the lower electrode film 60 in the above-described embodiment. However, it is needless to say that the laminated electrode 95 is not always necessary if the resistance value of the lower electrode film 60 is sufficiently reduced only by the connective wiring layer 120.

For example, the opening portion 111 is provided in the region opposing to the array of the pressure generating chamber 12 of the insulation layer 110 in the above-described embodiment. However, it is needless to say that the opening portion 111 need not be provided if the insulation layer 110 has a thickness which does not prevent the displacing of the vibration plate.

Moreover, for example, the above-described embodiment has been described based on the ink-jet recording head of a thin-film type, which is manufactured by application of the film-forming and lithography processes. However, it is needless to say that the present invention is not limited to the ink-jet recording head of the thin-film type. For example, the present invention is also applicable to an ink-jet recording head of a thick-film type, which is typically formed by the process of sticking a green sheet, and the like.

Figure 10:
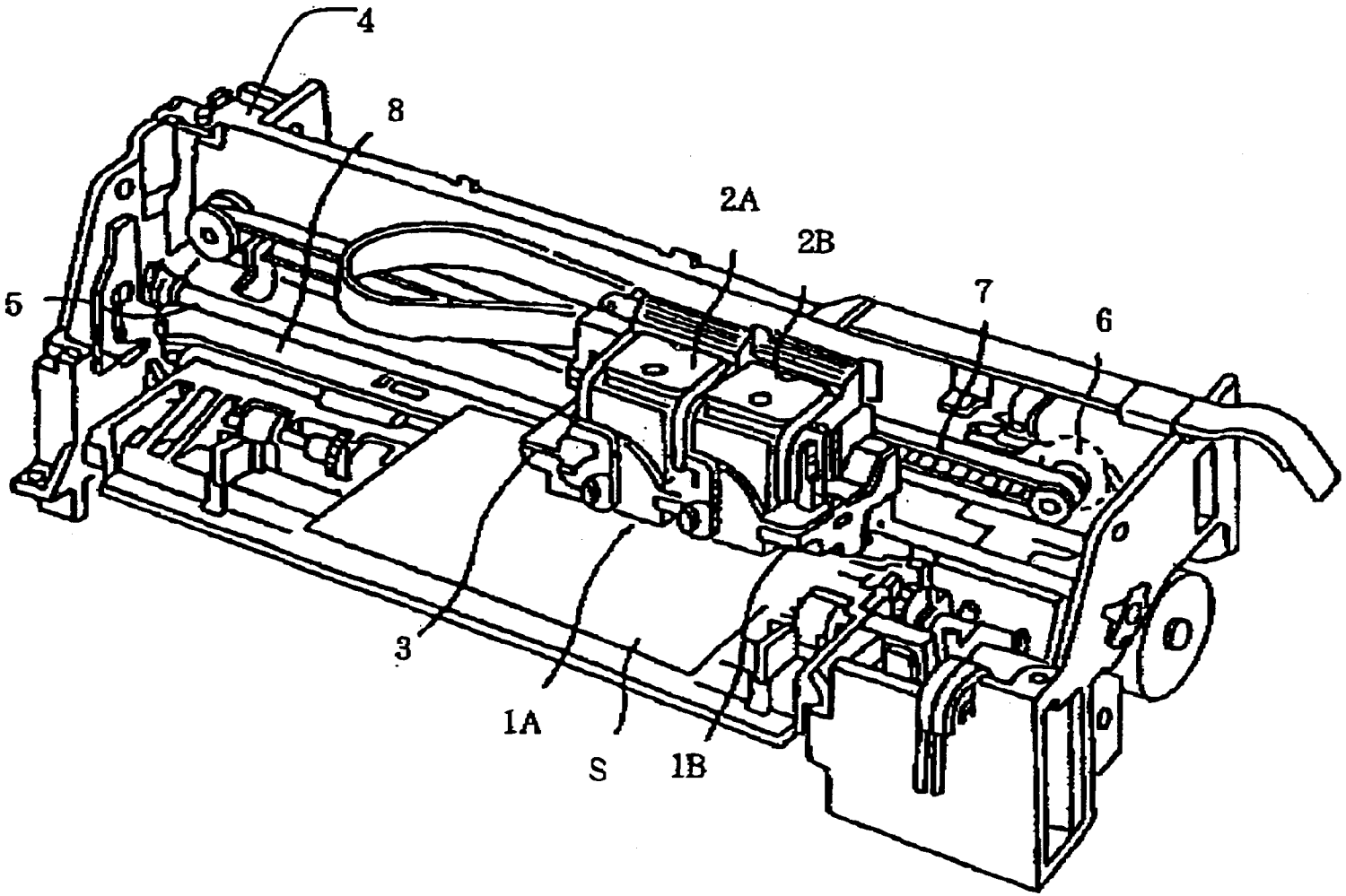
FIG. 10 is a schematic illustration of an ink-jet recording apparatus according to one embodiment of the present invention.

Meanwhile, the ink-jet recording head of each of the embodiments includes part of a recording head unit provided with an ink-flow path that communicates with an ink cartridge and the like, and the recording head unit is loaded into an ink-jet recording apparatus. FIG. 10 is a schematic illustration showing one example of the ink-jet recording apparatus.

As shown in FIG. 10, cartridges 2A and 2B are detachably provided on recording head units 1A and 1B having the ink-jet recording heads, respectively. A carriage 3 loading the recording head units 1A and 1B is disposed as movable in an axial direction on a carriage shaft 5 fitted to an apparatus body 4. These recording head units 1A and 1B are designed to eject a black ink composition and a color ink composition respectively, for example.

Moreover, driving force of a driving motor 6 is transmitted to the carriage 3 via an unillustrated plurality of gears and a timing belt 7, whereby the carriage 3 loading the recording head units 1A and 1B is allowed to move along the carriage shaft 5. Meanwhile, a platen 8 is provided on the apparatus body 4 along the carriage shaft 5, and a recording sheet S that is a recording medium such as paper fed by an unillustrated feeding roller or the like is conveyed onto the platen 8.

As described above, according to the present invention, a common electrode of a piezoelectric element is electrically connected to a connective wiring layer. Hence, a resistance value of the common electrode is substantially reduced, and a voltage drop does not occur if many piezoelectric elements are driven simultaneously. Moreover, the common electrode is electrically connected to the connective wiring layer via a penetrated portion provided on an insulation layer. Accordingly, it is possible to form the connective wiring layer in a region opposing to the piezoelectric element.

Therefore, the present invention exerts an effect that a favorable and stable ink ejecting characteristic can be obtained without increasing the size of the head.

Moreover, though the present invention has been described while exemplifying the ink-jet recording head that ejects ink as a liquid-jet head, the present invention is aimed to widely cover the overall liquid-jet heads and liquid-jet apparatuses. As such liquid-jet heads, for example, the following can be given: a recording head for use in an image recording apparatus such as a printer; a color-material-jet head for use in manufacturing a color filter of a liquid crystal display or the like; an electrode-material-jet head for use in forming electrodes of an organic EL display, an FED (field emission display) or the like; a bio-organic-material-jet head for use in manufacturing a biochip; and the like.

What is claimed is:

1. A liquid-jet recording head having a passage-forming substrate in which pressure generating chambers to communicate with nozzle orifices is formed, and piezoelectric elements provided on one side of the passage-forming substrate through a vibration plate to generate pressure changes inside the pressure generating chambers, the liquid-jet recording head comprising:

an insulation layer which is continuously provided at least in a region opposing to the vicinity of longitudinal end portions of the piezoelectric elements along a direction of arrangement of the piezoelectric elements, the insulation layer also having penetrated portions in a region opposing to a common electrode provided in common to the plurality of piezoelectric elements; and a connective wiring layer which is continuously provided on the insulation layer to be electrically connected to the common electrode through the penetrated portions.

2. The liquid-jet recording head according to claim 1, wherein the penetrated portions are provided on the insulation layer in regions opposing to compartment walls partitioning the pressure generating chambers, respectively.

3. The liquid-jet recording head according to claim 1, wherein the insulation layer in a region opposing to the pressure generating chamber is removed.

4. The liquid-jet recording head according to claim 1, wherein an extraction electrode which is drawn out of an individual electrode of the piezoelectric element extends to the vicinity of an end portion of the passage-forming substrate, and at least a position close to a tip portion of the extraction electrode constitutes an exposed portion where a surface thereof is exposed by removing the insulation layer and the connective wiring layer.

5. The liquid-jet recording head according to claim 4, wherein the exposed portion of the extraction electrode is made of the same layer as the connective wiring layer and is electrically connected to an independent wiring layer respectively, which is independent of the connective wiring layer.

6. The liquid-jet recording head according to claim 5, wherein the exposed portion of the extraction electrode is covered with the independent wiring layer.

7. The liquid-jet recording head according to claim 4, further comprising:

a laminated electrode layer which is provided on the common electrode in a region corresponding to outside of an array of the pressure generating chambers, the laminated electrode layer being made of the same layer as the extraction electrode and provided independently of the extraction electrode, wherein the laminated electrode layer is electrically connected to the connective wiring layer.

8. The liquid-jet recording head according to claim 1, wherein the insulation layer is made of photosensitive resin.

9. The liquid-jet recording head according to claim 8, wherein the photosensitive resin is polyimide resin.

10. The liquid-jet recording head according to claim 1, wherein the insulation layer is made of any one of fluorocarbon resin, silicone resin, epoxy resin, silicon oxide, silicon nitride, and tantalum oxide.

11. The liquid-jet recording head according to claim 1, wherein the common electrode has a film thickness within 0.5 $\mu$m.

12. The liquid-jet recording head according to claim 1, wherein the pressure generating chamber is formed on a single crystal silicon substrate by anisotropic etching, and the respective layers of the piezoelectric element are formed by a film-forming method and a lithography method.

13. A liquid-jet recording apparatus comprising:

the liquid-jet recording head according to any one of claims 1 to 12.

* * * * *